US006699366B2

(12) United States Patent
Paquin et al.

(10) Patent No.: US 6,699,366 B2
(45) Date of Patent: Mar. 2, 2004

(54) METHOD FOR JOINING NONWOVEN MESH PRODUCTS

(75) Inventors: Maurice R. Paquin, Averill Park, NY (US); James G. Donovan, Norwell, MA (US)

(73) Assignee: Albany International Corp., Albany, NY (US)

( * ) Notice: Subject to any disclaimer, the term of this patent is extended or adjusted under 35 U.S.C. 154(b) by 7 days.

(21) Appl. No.: 09/840,857

(22) Filed: Apr. 24, 2001

(65) Prior Publication Data

US 2001/0027593 A1 Oct. 11, 2001

Related U.S. Application Data

(62) Division of application No. 09/290,899, filed on Apr. 12, 1999, now Pat. No. 6,240,608.

(51) Int. Cl.[7] ..... D04H 13/00; D21F 3/00; B32B 5/06

(52) U.S. Cl. ..... 162/358.2; 162/348; 162/358.1; 162/900; 442/334

(58) Field of Search ..... 162/358.1–358.2, 162/358.3, 900, 301, 348; 428/102, 192, 193; 139/383 R, 383 B; 28/110, 135, 142, 100, 101, 107, 117, 158, 141; 442/60, 196, 269–271, 334, 327; 198/846–847

(56) References Cited

U.S. PATENT DOCUMENTS

| | | | | | |
|---|---|---|---|---|---|
| 3,121,660 | A | | 2/1964 | Hall, Jr. | 162/348 |
| 3,920,511 | A | * | 11/1975 | Grieves et al. | 162/348 |
| 4,018,646 | A | * | 4/1977 | Ruffo et al. | 162/146 |
| 4,427,734 | A | | 1/1984 | Johnson | 162/358 |
| 4,594,756 | A | * | 6/1986 | Beck | 28/100 |
| 4,740,409 | A | | 4/1988 | Lefkowitz | 428/131 |
| 4,798,760 | A | | 1/1989 | Diaz-Kotti | 428/234 |
| 4,830,915 | A | | 5/1989 | Diaz-Kotti | 428/110 |
| 4,878,278 | A | * | 11/1989 | Hsu et al. | 28/142 |
| 4,972,561 | A | * | 11/1990 | Aldrich | 28/142 |
| 5,268,076 | A | | 12/1993 | Best et al. | 162/348 |
| 5,328,759 | A | * | 7/1994 | McCormack et al. | 442/402 |
| 5,330,604 | A | | 7/1994 | Allum et al. | 156/304 |
| 5,360,656 | A | | 11/1994 | Rexfelt et al. | 428/193 |
| 5,466,339 | A | * | 11/1995 | Legge | 162/200 |
| 5,792,323 | A | * | 8/1998 | Grondahl | 162/358.4 |
| 5,837,080 | A | * | 11/1998 | Grondahl | 156/73.4 |
| 6,331,341 | B1 | * | 12/2001 | Joyce | 428/138 |

* cited by examiner

*Primary Examiner*—José A. Fortuna
(74) *Attorney, Agent, or Firm*—Frommer Lawrence & Haug; Ronald R. Santucci

(57) ABSTRACT

A press fabric for the press section of a paper machine has a base fabric which includes a nonwoven mesh fabric. The base fabric, or a layer thereof, is assembled in integral form using a strip or strips of the nonwoven mesh fabric. The assembly may be effected by spirally winding the nonwoven mesh fabric in a plurality of non-overlapping turns, by abutting each turn of the nonwoven mesh fabric against that previously wound, and by joining each turn of the nonwoven mesh fabric to that previously wound to form an endless loop. Alternatively, a plurality of endless loops of equivalent length are formed from separate strips of nonwoven mesh fabric, and arranged in a side-by-side abutting relationship. The endless loops are then joined, one to the next, to provide a base fabric, or component thereof, in the form of an endless loop.

29 Claims, 4 Drawing Sheets

METHOD FOR JOINING NONWOVEN MESH PRODUCTS

CROSS-REFERENCE TO RELATED APPLICATIONS

This, is a division of U.S. patent application Ser. No. 09/290,899, filed Apr. 12, 1999, now U.S. Pat. No. 6,240,608 B1.

BACKGROUND OF THE INVENTION

1. Field of the Invention

The present invention relates to the papermaking arts. More specifically, the present invention relates to press fabrics for the press section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from, the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, nonwoven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a papermachine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another one or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting or welding. Alternatively, adjacent longitudinal edge portions of adjoining spiral turns may be arranged overlappingly, so long as the edges have a reduced thickness, so as not to give rise to an increased thickness in the area of the overlap. Further, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine) direction, is the result. The lateral edges of the woven base fabric are then trimmed to render them parallel to its longitudinal (machine) direction. The angle between the machine direction of the woven base fabric and the helically continuous seam may be relatively small, that is, typically less than 10°. By the same token, the lengthwise (warp) yarns of the woven fabric strip make the same relatively small angle with the longitudinal (machine) direction of the woven, base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filing) yarns of the woven fabric strip align with the longitudinal (machine) or transverse (cross-machine) directions of the woven base fabric.

In the method shown in U.S. Pat. No. 5,360,656, the woven fabric strip is wound around two parallel rolls to assemble the woven base fabric. It will be recognized that endless base fabrics in a variety of widths and lengths may be provided by spirally winding a relatively narrow piece of woven fabric strip around the two parallel rolls, the length of a particular endless base fabric being determined by the length of each spiral turn of the woven fabric strip, and the width being determined by the number of spiral turns of the woven fabric strip. The prior necessity of weaving complete base fabrics of specified lengths and widths to order may thereby be avoided. Instead, a loom as narrow as 20 inches (0.5 meters) could be used to produce a woven fabric strip, but, for reasons of practicality, a conventional textile loom having a width of from 40 to 60 inches (1.0 to 1.5 meters) may be preferred.

Nevertheless, the method shown in U.S. Pat. No. 5,360, 656 still requires that a woven fabric strip be manufactured in an operation separate from the assembly of the woven base fabric. There remains considerable interest among manufacturers of paper machine clothing to streamline the process of manufacturing press fabrics still further by substituting a strip of nonwoven material for the woven fabric strip, thereby eliminating the weaving process altogether. Needless to say, the manufacture of the strip of nonwoven material would be less time-consuming and more efficient, per unit length, than the production of a woven fabric strip.

Commonly assigned U.S. Pat. No. 4,427,734 to Johnson, the teachings of which are incorporated herein by reference, shows a press fabric which comprises a base fabric of interwoven textile yarns and a plurality of nonwoven layers of synthetic textile fibers, each nonwoven layer being attached to adjacent layers and collectively to the base fabric by needling. Interposed between adjacent nonwoven layers of the synthetic textile fibers is a layer of mesh fabric. In preferred embodiments, the mesh fabric is a nonwoven mesh fabric fabricated by extrusion or like techniques from thermoplastic resins, such as polypropylene, polyethylene and the like. The nonwoven mesh fabric has a net-like structure of monofilament-like ribs or yarns, which may be oriented in the lengthwise and crosswise directions of a strip of the nonwoven mesh fabric.

U.S. Pat. Nos. 4,798,760 and 4,830,915 show press fabrics having more than one layer of nonwoven mesh fabric. In the former patent, the press fabric includes a woven base fabric in the latter, there is no woven base fabric.

To its advantage, the nonwoven mesh fabrics shown in these prior-art patents provide the press fabrics with additional void volume, and layers formed therefrom are more resistant to compaction than those formed from woven fabrics. In addition, lacking the knuckles which characterize the surfaces of woven fabrics, a nonwoven mesh fabric used in the topmost, or paper-contacting, layer of a press fabric contributes to the production of a smooth, mark-free paper sheet.

Unfortunately, the use of nonwoven mesh fabrics in press fabrics has been limited by their lack of availability in widths greater than 150 inches (3.8 meters), while the press fabrics themselves can easily be 400 inches (10.2 meters) or more in width.

The present invention provides a method for joining nonwoven mesh fabrics together so that they may be more widely used as components in press fabrics for paper machines.

SUMMARY OF THE INVENTION

Accordingly, the present invention is both a method for manufacturing a press fabric for the press section of a paper machine, and the press fabrics obtained through the practice of the method. The press fabrics include base fabrics formed by joining a strip or strips of nonwoven mesh fabric together to form an endless loop of the desired size having a machine direction, a cross-machine direction, an inner surface and an outer surface. The endless loops so obtained may themselves be used as base fabrics, or may be included as a component of a laminated base. fabric.

The base fabrics may be assembled from a strip or strips of nonwoven mesh fabric in two ways. In the first, a strip of nonwoven mesh fabric is spirally wound in a plurality of non-overlapping turns. Each turn of the spirally wound nonwoven mesh fabric is abutted against that previously wound, and joined thereto by sewing, stitching, melting or welding. This yields a base fabric of a width greater than that of the strip of nonwoven mesh fabric in the form of an endless loop having an inner surface, an outer surface, a longitudinal direction and a transverse direction.

In the second of the two ways, a plurality of endless loops of equivalent preselected length are formed from strips of nonwoven mesh fabric. The plurality of endless loops are arranged in a side-by-side relationship and abutted, one with the next. Each endless loop is then joined to those on either side by sewing, stitching, melting or welding. This again yields a base fabric of width greater than that of the strips of nonwoven mesh fabric in the form of an endless loop having an inner surface, an outer surface, a longitudinal direction and a transverse direction, with the difference that the strips of nonwoven mesh fabric are oriented longitudinally rather than being spirally wound.

The present invention will now be described in more complete detail with frequent reference being made to the drawing figures identified below.

DETAILED DESCRIPTION OF THE PREFERRED EMBODIMENTS

Figure 1:
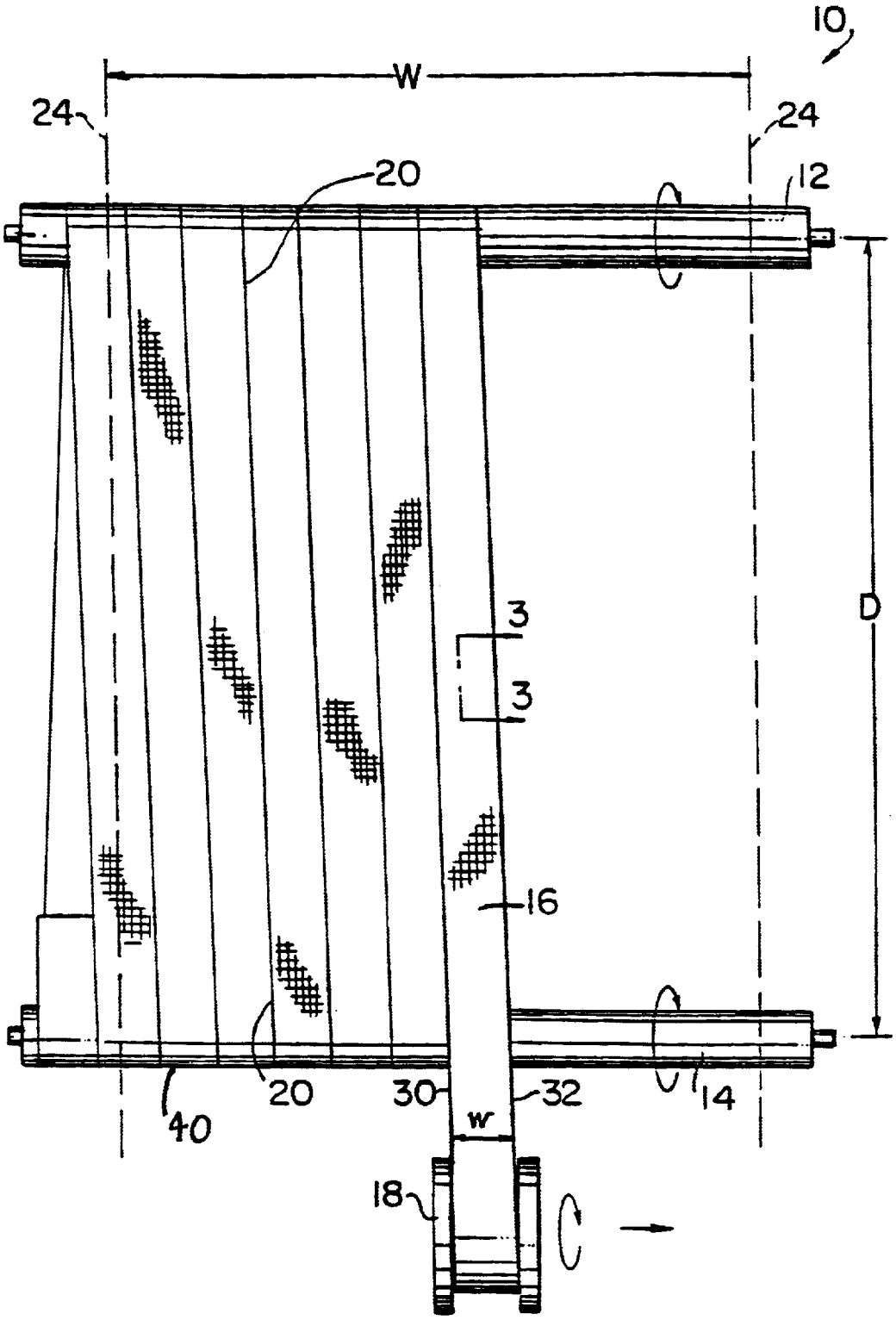
FIG. 1 is a schematic top plan view illustrating a method for manufacturing a base fabric for the press fabric of the present invention.

Referring now to the several figures, FIG. 1 is a schematic top plan view illustrating a method for joining nonwoven mesh fabrics edge-to-edge to assemble endless loops therefrom for use as base fabrics, or as components of base fabrics, for press fabrics for paper machines. The method may be practiced using an apparatus 10 comprising a first roll 12 and a second roll 14, which are parallel to one another and which may be rotated in the directions indicated by the arrows in FIG. 1. A nonwoven mesh fabric 16 in the form of a strip is wound from a stock roll 18 around the first roll 12 and the second roll 14 in a continuous spiral. It will be recognized that it may be necessary to translate the stock roll 18 at a suitable rate along second roll 14 (to the right in FIG. 1) as the nonwoven mesh fabric 16 is being wound around the rolls 12,14.

Figure 2:
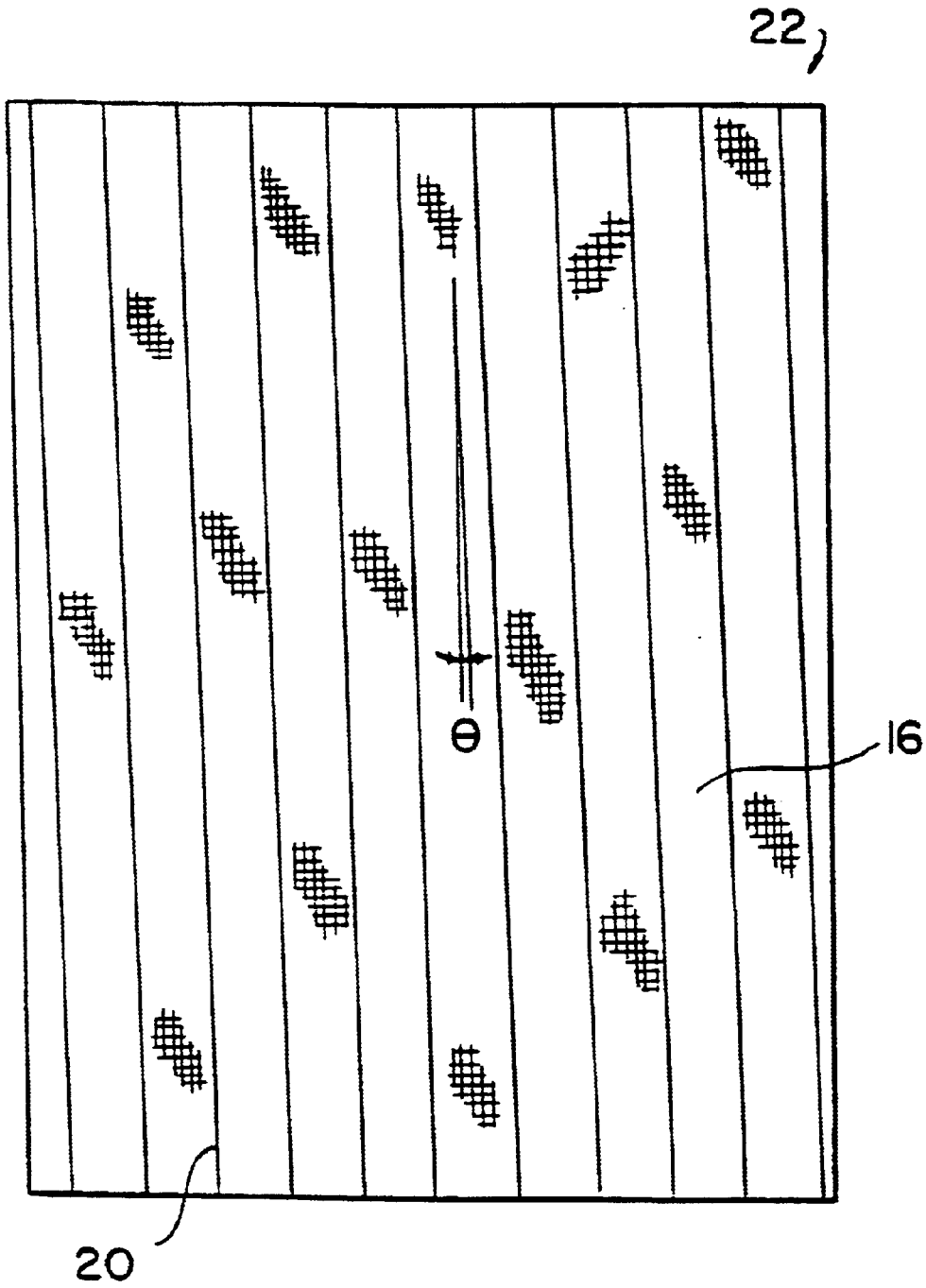
FIG. 2 is a top plan view of a finished base fabric.

The first roll 12 and the second roll 14 are separated by a distance D, which is determined with reference to the total length, C, required for the base fabric, or component thereof, being manufactured, the total length, C, measured longitudinally (in the machine direction) about its endless-loop form. Nonwoven mesh fabric 16, having a width w, is spirally wound onto the first and second rolls 12,14 in a plurality of turns from stock roll 18, which may be translated along the second roll 14 in the course of the winding. Successive turns of the nonwoven mesh fabric 16 are abutted edge-to-edge against one another and are attached to one another along helically continuous seam 20 by sewing, stitching, melting or welding to produce base fabric 22 as shown in FIG. 2. When a sufficient number of turns of the nonwoven mesh fabric 16 have been made to produce base fabric 22 in the desired width W, that width being measured transversely (in the cross-machine direction) across the endless-loop form of the base fabric 22, the spiral winding is concluded. The base fabric 22 so obtained has an inner surface, an outer surface, a machine direction and a cross-machine direction. Initially, the lateral edges of the base fabric 22, it will be apparent, will not be parallel to the machine direction thereof, and must be trimmed along lines 24 to provide the base fabric 22 with the desired width W, and with two lateral edges parallel to the machine direction of its endless-loop form.

Figure 3:
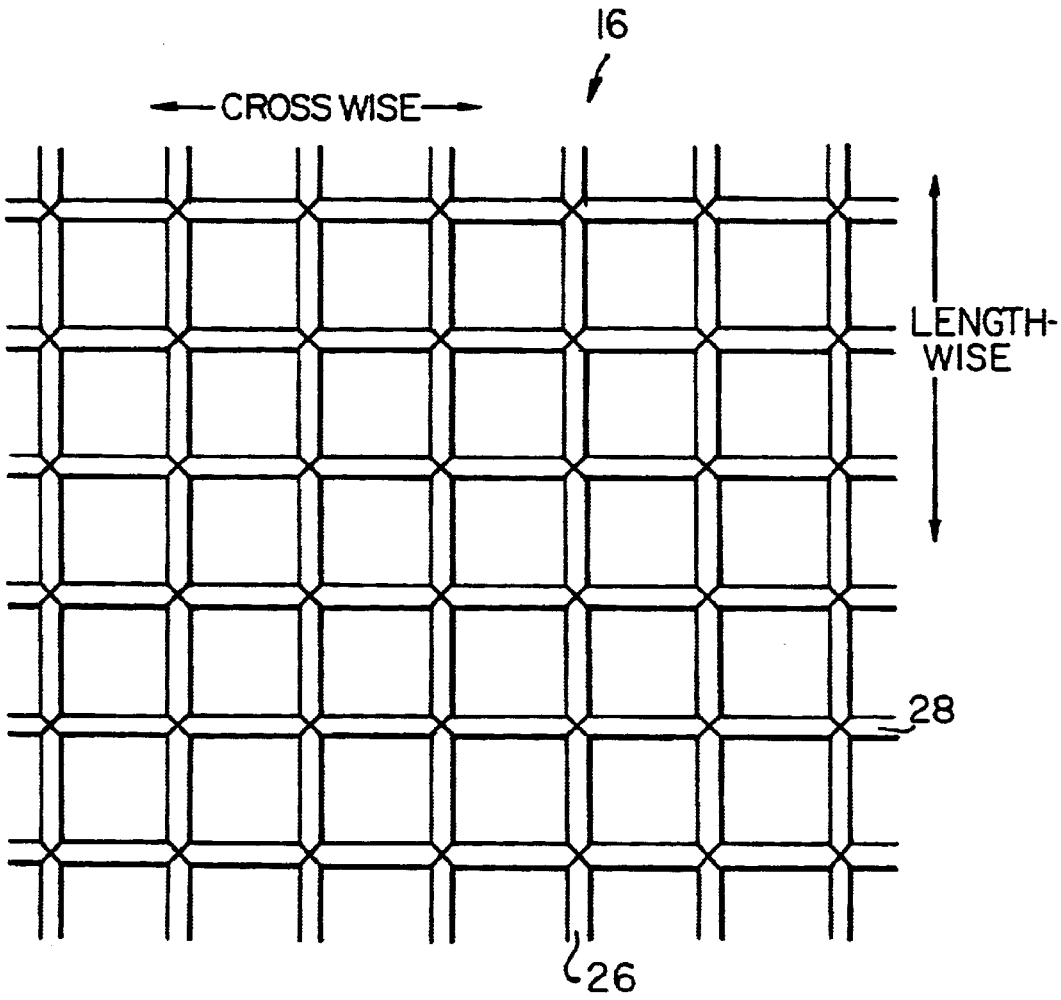
FIG. 3 is a top plan view of a nonwoven mesh fabric.
Figure 4:
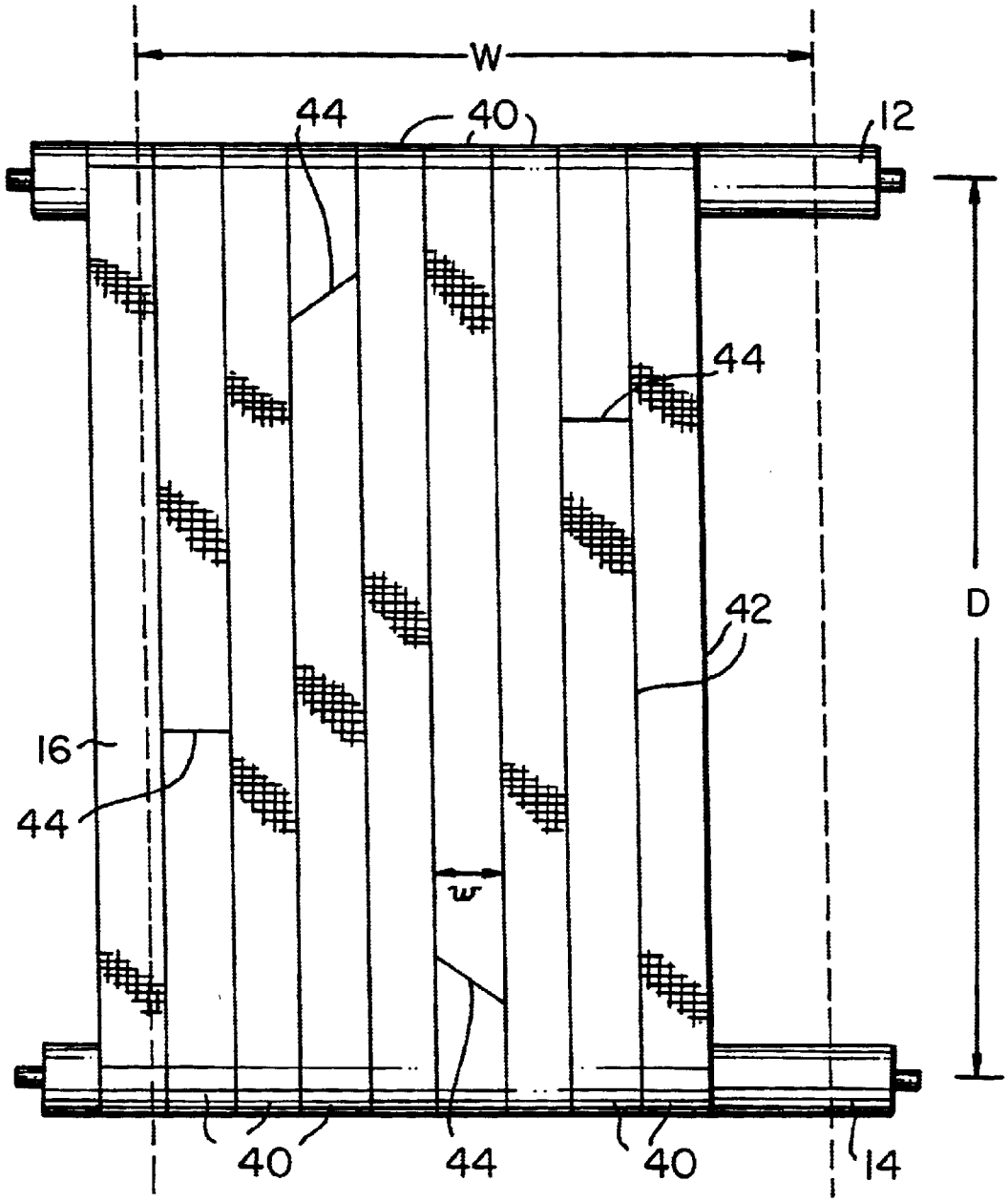
FIG. 4 is a schematic top plan view illustrating an alternative method for manufacturing a base fabric for the press fabric.

Nonwoven mesh fabric 16 may be of the variety disclosed in commonly assigned U.S. Pat. No. 4,427,734 to Johnson, the teachings of which are incorporated herein by reference. A plan view of the *nonwoven mesh fabric 16 is provided in FIG. 3. The nonwoven mesh fabric 16 has a net-like structure of ribs or yarns defining a mesh. The monofilament-like elements 26,28 making up the nonwoven mesh fabric 16 are oriented in the lengthwise and crosswise directions thereof, respectively. It should be understood, however, that the monofilament-like elements may alternatively be oriented diagonally relative to the lengthwise and crosswise directions of the nonwoven mesh fabric.

The nonwoven mesh fabric 16 is fabricated by extrusion or like techniques from thermoplastic resins, such as polyamide, polypropylene, polyethylene and the like.

The monofilament-like elements 26,28 may themselves have widths or diameters in a range from 0.1 mm to 0.5 mm, although the widths or diameters may be as large as 1.0 mm. Monofilament-like elements 26,28 may each be of a different width or diameter. Moreover, monofilament-like elements 26,28 may be of circular, square or rectangular cross section. A typical rectangular dimension would be, for example, 0.5 mm (wide) by 0.2 mm (thick). Finally, monofilament-like elements 26,28 may be separated from those adjacent thereto by a spacing in the range from 0.1 mm to 2.0 mm.

Because the non-woven mesh fabric 16 is spirally wound to assemble base fabric 22, the monofilament-like elements 26,28 making up the nonwoven mesh fabric 16 do not align with the machine and cross-machine directions, respectively, of the base fabric 22. Rather, the lengthwise monofilament-like elements 26 of the nonwoven mesh fabric 16 make a slight angle, θ, whose magnitude is a measure of the pitch of the spiral windings of the nonwoven mesh fabric 16, with respect to the machine direction of the base fabric 22, as suggested by the top plan view thereof shown in FIG. 2. This angle, as previously noted, is typically less than 10°. Because the lengthwise and crosswise monofilament-like elements 26,28 generally cross one another at a 90° angle, the crosswise monofilament-like elements 28 make the same slight angle, θ, with respect to the cross-machine direction of the base fabric 22.

Nonwoven mesh fabric 16 has a first lateral edge 30 and a second lateral edge 32 which together define the width w of the nonwoven mesh fabric 16. As the nonwoven mesh fabric 16 is being spirally wound onto the first and second rolls 12,14, the first lateral edge 30 of each turn is abutted against the second lateral edge 32 of the immediately preceding turn, and joined thereto by sewing, stitching, melting or welding.

In an alternative method, the nonwoven mesh fabric 16 may be looped around the first and second rolls 12,14 in a direction perpendicular thereto, rather than spirally wound thereabout. In this manner, an endless loop having a width w, may be formed from the nonwoven mesh fabric 16 by attaching its ends to one another by sewing, stitching, melting or welding. The ends are temporarily held or clamped together while being so attached to each other. The ends may be cut in the crosswise direction of the nonwoven mesh fabric 16, or in a direction between the lengthwise and crosswise directions, that is, on a bias. In order to produce a base fabric of width W, a plurality of endless loops 40, each having a width w, is assembled in this manner about the first and second rolls 12,14, each endless loop being abutted side-by-side against the next and its lengthwise edges 42 attached to those of adjacent loops by sewing, stitching, melting or welding. The seams 44 formed where the ends of nonwoven mesh fabric 16 are joined to make endless loops 40 are preferably staggered in the machine direction of the base fabric being manufactured so as not to produce a continuous seam in the cross-machine direction thereof. This process is continued until the width of the attached endless loops 40, which is some integer multiple of the width w of each endless loop 40, equals or exceeds the width W desired for the base fabric. When the width obtained exceeds that desired, the lateral edge or edges of the attached endless loops may be trimmed in the machine direction to bring the width down to the desired value W.

Whether spirally or longitudinally wound, base fabrics assembled from nonwoven mesh fabrics may be layered one atop (or around) the other to provide a laminated base fabric having no woven elements. That is to say, each subsequent layer is assembled on top of those previously assembled on apparatus 10. Any number of such base fabrics may be so layered to provide a laminated base fabric having a plurality of layers. Where the base fabric is layered, each of its plurality of layers may be made from a nonwoven mesh fabric 16 made of a different thermoplastic resin and/or of a different mesh value.

Further, where a laminated base fabric comprises two spirally wound layers, one of the layers may be produced by spirally winding the nonwoven mesh fabric 16 in one direction, and the other layer may be produced by spirally winding the nonwoven mesh fabric 16 in the other direction, so that one layer will be in the form of a right-handed spiral, while the other will be in the form of a left-handed spiral.

Moreover, where a laminated base fabric comprises two longitudinally wound layers, it is preferred that the seams formed where lengthwise edges 42 are attached together in one layer not overlap those in the other layer. This can be ensured by offsetting one layer from the other, or by using strips of nonwoven mesh fabric 16 having different widths for each of the two layers, so that the seams between lengthwise edges 42 never overlap one another.

In any event, one or both surfaces of either a single-layer or laminated base fabric assembled from a nonwoven mesh fabric may have a plurality of layers of staple fiber material attached thereto by needling. Where the base fabric is laminated, the staple fiber material provides the attachment of the individual base fabric layers to one another. Moreover, where the base fabric is laminated, one or more layers of staple fiber material may be included between adjacent layers.

Modifications to the press fabrics so produced would be obvious to those of ordinary skill in the art, but would not bring the invention so modified beyond the scope of the appended claims. For example, the base fabric thereof may also comprise, in addition to one or more layers formed by spirally or longitudinally winding a nonwoven mesh fabric, one or more layers of standard base fabric. That is to say, one or more additional layers may be formed by fabrics having machine and cross-machine direction yarns and produced by techniques well-known to those of ordinary skill in the art. Such a fabric may be woven endless in the dimensions required for the paper machine for which it is intended, or flat woven and subsequently rendered into endless form with a woven seam. It may also be produced by a modified endless weaving technique to be on-machine-seamable. Laminated fabrics, having one or more standard base fabric layers, may also be used. Finally, one or more additional layers may be formed by spirally winding a woven fabric strip in a plurality of turns about a pair of rolls, by abutting adjacent turns of the spirally wound woven fabric strip against one another, and by closing the helically continuous seam so produced by sewing, stitching, melting or welding, in the manner taught in commonly assigned U.S. Pat. No. 5,360,656.

What in claimed is:

1. A press fabric for the press section of a paper machine, said press fabric comprising:

a base fabric, said base fabric having a first layer, said first layer comprising a first nonwoven mesh fabric strip, said first nonwoven mesh fabric strip having a first lateral edge and a second lateral edge, said first nonwoven mesh fabric strip being spirally wound in a plurality of contiguous turns wherein said first lateral edge in a turn of said first nonwoven mesh fabric strip abuts said second lateral edge of an adjacent turn thereof, thereby forming a helically continuous seam separating adjacent turns of said first nonwoven mesh fabric strip, said helically continuous seam being closed by attaching abutting first and second lateral edges of said first nonwoven mesh fabric strip to one another, thereby providing said first layer and said base fabric in the form of an endless loop having a machine direction, a cross-machine direction, an inner surface and an outer surface; and a plurality of layers of staple fiber material attached to one of said inner and outer surfaces of said base fabric by needling.

2. A press fabric as claimed in claim 1 further comprising:

a second layer, said second layer comprising a plurality of endless loops of equivalent preselected length of a nonwoven mesh fabric, each of said endless loops having a first lateral edge and a second lateral edge, said plurality of endless loops being in a side-by-side abutting relationship wherein said first lateral edge of one endless loop is joined to said second lateral edge of that adjacent thereto, thereby providing said second layer in the form of an endless loop having a machine direction, a cross-machine direction, an inner surface and an outer surface, said endless loop formed by said second layer being on top of (around) said endless loop formed by said first layer.

3. A press fabric as claimed in claim 2 further comprising at least one layer of staple fiber material between said first and second layers of said base fabric.

4. A press fabric as claimed in claim 1 further comprising:

a second layer, said second layer comprising a second nonwoven mesh fabric strip, said second nonwoven mesh fabric strip having a first lateral edge and a second lateral edge, said second nonwoven mesh fabric strip being spirally wound in a plurality of contiguous turns wherein said first lateral edge in a turn said second nonwoven mesh fabric strip abuts said second lateral edge of an adjacent turn thereof, thereby forming a helically continuous seam separating adjacent turns of said second nonwoven mesh fabric strip, said helically continuous seam being closed by attaching abutting first and second lateral edges of is said second nonwoven mesh fabric strip to one another, thereby providing said second layer in the form of an endless loop having a machine direction, a cross-machine direction, and inner surface and an outer surface, said endless loop formed by said second layer being on top of (around) said endless loop formed by said first layer.

5. A press fabric as claimed in claim 4 further comprising at least one, layer of staple fiber material between said first and second layers of said base fabric.

6. A press fabric as claimed in claim 4 wherein said second layer of said base fabric is spirally wound in a direction opposite to that of said first layer of said base fabric.

7. A press fabric as claimed in claim 1 further comprising:

a second layer, said second layer comprising a woven base fabric having machine-direction and cross-machine-direction yarns, said woven base fabric being in the form of an endless loop having a machine direction, a cross-machine direction, an inner surface and an outer surface, said endless loop formed by said second layer being inside of said endless loop formed by said first layer.

8. A press fabric as claimed in claim 7 further comprising at least one layer of staple fiber material between said first and second layers of said base fabric.

9. A press fabric as claimed in claim 1 further comprising a plurality of layers of staple fiber material attached to the other of said inner and outer surfaces of said base fabric by needling.

10. A press fabric for the press section of a paper machine, said press fabric comprising:

a base fabric, said base fabric having a first layer, said first layer comprising a plurality of endless loops of equivalent preselected length of a nonwoven mesh fabric, each of said endless loops having a first lateral edge and a second lateral edge, said plurality of endless loops being in a side-by-side abutting relationship wherein said first lateral edge of one endless loop is joined to said second lateral edge of that adjacent thereto, thereby providing said first layer and said base fabric in the form of an endless loop having a machine direction, a cross-machine direction, an inner surface and an outer surface; and a plurality of layers of staple fiber material attached to one of said inner and outer surfaces of said base fabric by needling.

11. A press fabric as claimed in claim 10 further comprising:

a second layer, said second layer comprising a second plurality of endless loops of equivalent preselected lengths of a nonwoven mesh fabric, each of said endless loops having a first lateral edge and a second lateral edge, said second plurality of endless loops being in a side-by-side abutting relationship wherein said first lateral edge of one endless loop is joined to said second lateral edge of that adjacent thereto, thereby providing said second layer in the form of an endless loop having a machine direction, a cross-machine direction, an inner surface and an outer surface, said endless loop formed by said second layer being on top of (around) said endless loop formed by said first layer.

12. A press fabric as claimed in claim 11 further comprising at least one layer of staple fiber material between said first and second layers of said base fabric.

13. A press fabric as claimed in claims 2, 10 or 11 wherein said nonwoven mesh fabric is a net-like structure of monofilament-like elements, and has a lengthwise direction and a crosswise direction.

14. A press fabric as claimed in claim 13 wherein said monofilament-like elements are oriented in said lengthwise and crosswise directions.

15. A press fabric as claimed in claim 13 wherein said nonwoven mesh fabric is extruded from a thermoplastic resin.

16. A press fabric as claimed in claim 15 wherein said thermoplastic resin is selected from the group consisting of polyamide, polypropylene and polyethylene.

17. A press fabric as claimed in claim 13 wherein said monofilament-like elements have a width in the range from 0.1 mm to 1.0 mm.

18. A press fabric as claimed in claim 13 wherein said monofilament-like elements are spaced from one another by a distance in the range-from 0.1 mm to 2.0 mm.

19. A press fabric as claimed in claim 10 further comprising:

a second layer, said second layer comprising a nonwoven mesh fabric strip, said nonwoven mesh fabric strip having a first lateral edge and a second lateral edge, said nonwoven mesh fabric strip being spirally wound in a plurality of contiguous turns wherein said first lateral edge in a turn of said nonwoven mesh fabric strip abuts said second lateral edge of an adjacent turn thereof, thereby forming a helically continuous seam separating adjacent turns of said nonwoven mesh fabric strip, said helically continuous seam being closed by attaching abutting first and second lateral edges of said nonwoven mesh fabric strip to one another, thereby providing said second layer in the form of an endless loop having a machine direction, a cross-machine direction, an inner surface and an outer surface, said endless loop formed by said second layer being on top of (around) said endless loop formed by said first layer.

20. A press fabric as claimed in claim 19 further comprising at least one layer of staple fiber material between said first and second layers of said base fabric.

21. A press fabric as claimed in claims 1,4 or 19 wherein said nonwoven mesh fabric strip is a net-like structure of monofilament-like elements, and has a lengthwise direction and a crosswise-direction.

22. A press fabric as claimed in claim 21 wherein said monofilament-like elements are oriented in said lengthwise and crosswise directions.

23. A press fabric as claimed in claim 21 wherein said nonwoven mesh fabric strip is extruded from a thermoplastic resin.

24. A press fabric as claimed in claim 23 wherein said thermoplastic resin is selected from the group consisting of polyamide, polypropylene and polyethylene.

25. A press fabric as claimed in claim 21 wherein said monofilament-like elements have a width in the range from 0.1 mm to 1.0 mm.

26. A press fabric as claimed in claim 21 wherein said monofilament-like elements are spaced from one another by a distance in the range from 0.1 mm to 2.0 mm.

27. A press fabric as claimed in claim 10 further comprising:

a second layer, said second layer comprising a woven base fabric having machine-direction and cross-machine-direction yarns, said woven base fabric being in the form of an endless loop having a machine direction, a cross-machine direction, an inner surface and an outer surface, said endless loop formed by said second layer being inside of said endless loop formed by said first layer.

28. A press fabric as claimed in claim 27 further comprising at least one layer of staple fiber material between said first and second layers of said base fabric.

29. A press fabric as claimed in claim 10 further comprising a plurality of layers of staple fiber material attached to the other of said inner and outer surfaces of said base fabric by needling.

* * * * *